US009940819B2

(12) United States Patent
Ferniany

(10) Patent No.: US 9,940,819 B2
(45) Date of Patent: Apr. 10, 2018

(54) SYSTEMS AND METHODS FOR ENCOURAGING HAND WASHING COMPLIANCE

(71) Applicant: THE UAB RESEARCH FOUNDATION, Birmingham, AL (US)

(72) Inventor: William Ferniany, Birmingham, AL (US)

(73) Assignee: THE UAB RESEARCH FOUNDATION, Birmingham, AL (US)

( * ) Notice: Subject to any disclaimer, the term of this patent is extended or adjusted under 35 U.S.C. 154(b) by 0 days.

(21) Appl. No.: 15/148,143

(22) Filed: May 6, 2016

(65) Prior Publication Data

US 2016/0328948 A1 Nov. 10, 2016

Related U.S. Application Data

(60) Provisional application No. 62/157,745, filed on May 6, 2015.

(51) Int. Cl.
*G08B 23/00* (2006.01)
*G08B 21/24* (2006.01)
(Continued)

(52) U.S. Cl.
CPC ..... *G08B 21/245* (2013.01); *A47K 5/1217* (2013.01); *B05B 15/061* (2013.01); *B05B 15/62* (2018.02)

(58) Field of Classification Search
None
See application file for complete search history.

(56) References Cited

U.S. PATENT DOCUMENTS 4,896,144 A 1/1990 Bogstad
6,975,231 B2 * 12/2005 Lane ..... G08B 21/245 340/539.1
(Continued)

FOREIGN PATENT DOCUMENTS

CN 202677403 1/2013
WO WO2013058821 A1 4/2013
(Continued)

*Primary Examiner* — George Bugg
*Assistant Examiner* — Renee Dorsey
(74) *Attorney, Agent, or Firm* — Thomas | Horstemeyer, LLP; Christopher B. Linder; Jason M. Perilla

(57) ABSTRACT

In some embodiments, a hand washing compliance system includes a primary soap dispenser adapted to be located near an entrance to a room, the primary soap dispenser comprising a motion sensor configured to detect passage of an individual through the room entrance, a soap dispensation sensor configured to detect dispensation of soap from the primary soap dispenser, and a communication device configured to enable communication with other soap dispensers, and a secondary soap dispenser adapted to be located inside of the room, the secondary soap dispenser comprising a soap dispensation sensor configured to detect dispensation of soap from the secondary soap dispenser, a communication device configured to enable communication with other soap dispensers, and a warning indicator configured to generate an alert that encourages individuals entering the room to wash their hands.

9 Claims, 7 Drawing Sheets

(51) Int. Cl.
*A47K 5/12* (2006.01)
*B05B 15/06* (2006.01)

(56) References Cited

U.S. PATENT DOCUMENTS

| | | | | |
|---|---|---|---|---|
| 8,344,893 | B1 | 1/2013 | Drammeh | |
| 8,482,406 | B2 | 7/2013 | Snodgrass | |
| 8,558,660 | B2 | 10/2013 | Nix et al. | |
| 8,564,431 | B2 | 10/2013 | Snodgrass | |
| 8,744,623 | B2 | 6/2014 | Drake et al. | |
| 9,030,325 | B2 | 5/2015 | Tanesff | |
| 9,047,755 | B2 | 6/2015 | Bonner | |
| 9,060,655 | B2 | 6/2015 | Iseri et al. | |
| 9,123,233 | B2 | 9/2015 | Hermann | |
| 9,159,216 | B2 | 10/2015 | Limbert et al. | |
| 2002/0000449 | A1 | 1/2002 | Armstrong | |
| 2009/0224907 | A1* | 9/2009 | Sinha | G08B 21/245 340/539.11 |
| 2010/0164728 | A1* | 7/2010 | Plost | G08B 21/245 340/573.1 |
| 2011/0234407 | A1 | 9/2011 | Harris et al. | |
| 2012/0062382 | A1 | 3/2012 | Taneff | |
| 2012/0112906 | A1* | 5/2012 | Borke | G06F 19/327 340/539.13 |
| 2012/0212582 | A1* | 8/2012 | Deutsch | G08B 21/245 348/46 |
| 2012/0303159 | A1 | 11/2012 | Drake et al. | |
| 2013/0002571 | A1 | 1/2013 | Skinner | |
| 2013/0027199 | A1 | 1/2013 | Bonner | |
| 2013/0229276 | A1* | 9/2013 | Hunter | G08B 21/245 340/501 |
| 2014/0074285 | A1 | 3/2014 | Wegelin et al. | |
| 2014/0225732 | A1 | 8/2014 | Limbert et al. | |
| 2014/0266692 | A1* | 9/2014 | Freedman | G08B 21/245 340/539.11 |
| 2014/0279603 | A1* | 9/2014 | Ortiz | G06Q 30/018 705/317 |
| 2015/0194043 | A1 | 7/2015 | Dunn et al. | |
| 2015/0228181 | A1 | 8/2015 | Himmelmann et al. | |
| 2015/0235549 | A1 | 8/2015 | Debmed | |
| 2015/0313422 | A1* | 11/2015 | Ophardt | H02J 7/0052 222/1 |
| 2016/0042635 | A1* | 2/2016 | Rosebraugh | G08B 21/245 340/573.1 |

FOREIGN PATENT DOCUMENTS

| | | | |
|---|---|---|---|
| WO | WO2013070888 | A1 | 10/2013 |
| WO | WO2013151933 | A1 | 10/2013 |
| WO | WO2014060726 | A1 | 4/2014 |
| WO | WO2014145400 | A1 | 9/2014 |
| WO | WO2015109022 | A1 | 7/2015 |
| WO | WO2015117112 | A1 | 8/2015 |

* cited by examiner

SYSTEMS AND METHODS FOR ENCOURAGING HAND WASHING COMPLIANCE

CROSS-REFERENCE TO RELATED APPLICATION

This application claims priority to U.S. Provisional Application Ser. No. 62/157,745, filed May 6, 2015, which is hereby incorporated by reference herein in its entirety.

BACKGROUND

Hand washing is an important practice for limiting the spread of disease and infection within hospitals. Most hospitals have a "wash-in, wash-out" policy in which hospital staff members, such as doctors and nurses, are required to wash their hands both before entering a patient's room and after leaving it. Unfortunately, compliance with such policies is typically only in the 50 to 60% range.

Because of the low compliance with wash-in, wash-out policies, several hospitals have installed sophisticated hygiene compliance systems that automatically track staff members and their hand washing habits. In such systems, each staff member wears an identification badge that is automatically scanned by the system when the staff member enters or exits a patient room. The system detects whether or not soap was dispensed to the staff member and then logs whether or not the staff member washed his or her hands.

While such hygiene compliance systems can be effective, they have several inherent drawbacks. As a first matter, these systems are relatively complex and are, therefore, relatively expensive to purchase and install. In addition, some staff members do not appreciate being individually monitored by the system and feel as though it is too intrusive. Furthermore, these systems only work for individuals who are wearing a badge. Therefore, they are ineffective in relation to staff members who are not wearing their badge or members of the general public, such as patient family members.

In view of the above discussion, it can be appreciated that it would be desirable to have an alternative system and method for encouraging individuals to wash their hands in hospital settings.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have an alternative system and method for encouraging individuals to wash their hands in hospital settings. Disclosed herein are simple and inexpensive hand washing compliance systems and methods that are configured to encourage all individuals, and not just hospital staff members, to at least wash their hands prior to entering a hospital room. In some embodiments, a hand washing compliance system comprises a primary soap dispenser that is located near the entrance of the room and one or more secondary soap dispensers that are located within the room. The primary and secondary soap dispensers comprise electronics including motion sensors, soap dispensation sensors, and communication devices that enable the dispensers to communicate with each other and share information.

The compliance system can be configured to operate in various ways. In some embodiments, the primary soap dispenser is configured to detect when any individual enters the room and, if the individual had not already dispensed soap from the primary soap dispenser, signal the one or more secondary soap dispensers in the room to notify them of this fact. If, the individual does not dispense soap from one of the soap dispensers after a predetermined period of time, a visual and/or audible alert is emitted. When the alert is emitted, the individual is reminded to wash his or her hands and the others in the room are notified that the individual (e.g., a hospital staff member) is not in compliance with hospital policy. Accordingly, not only is the individual reminded to wash, the individual is further encouraged to wash to appease others in the room. If the individual then dispenses soap from any of the soap dispensers, the alert is canceled. If, on the other hand, the individual does not dispense soap after a further predetermined period of time, the alert can escalate in intensity to further encourage the individual to wash his or her hands. In some embodiments, a similar process can be performed by the system when any individual exits the room.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
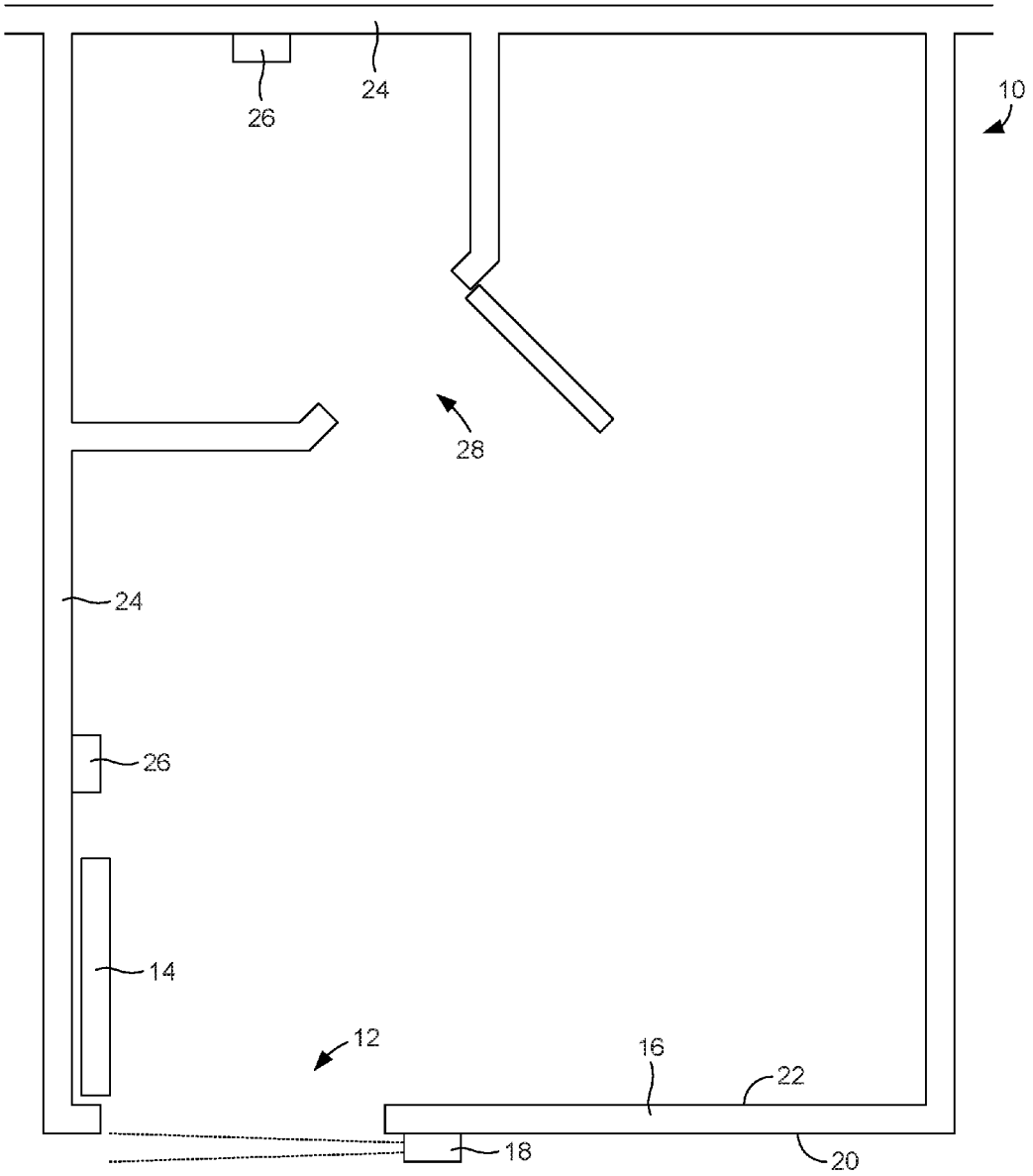
FIG. 1 is a schematic diagram of a hospital room in which a hand washing compliance system comprising multiple soap dispensers has been installed.

FIG. 1 illustrates an example hospital room 10, such as a patient room. The room 10 includes a room entrance 12 that can be closed with a door 14. Mounted to an outer wall 16 along which the entrance 12 is formed is a primary soap dispenser 18. In the illustrated embodiment, the soap dispenser 18 is mounted to an outer side 20 of the outer wall 16 so as to be located outside of the room 10. In other embodiments, however, the soap dispenser 18 can be mounted to an inner side 22 of the outer wall 16 so as to be located within the room 10. As its name suggests, the soap dispenser 18 is configured to dispense soap for hand washing, for example, when an individual places his or her hand under the dispenser. While the dispenser 18 is described as a "soap" dispenser, it is to be understood that the "soap" dispensers disclosed herein are configured to store and dispense any material, whether it be a soap, a disinfectant, or other material, that is intended to be used to cleanse one's hands to decrease the spread disease or infection. As described below, the primary soap dispenser 18 is configured to detect entry of an individual into the room 10 as well as dispensation of soap from the soap dispenser.

Mounted to an inside wall 24 within the room 10 is a first secondary soap dispenser 26. Like the primary soap dispenser 18, the secondary soap dispenser 26 is configured to store and dispense soap as well as to detect dispensation of soap from the soap dispenser. In the embodiment of FIG. 1, a second secondary soap dispenser 26 is mounted to another inside wall 24, in this case within a bathroom 28 located within the room 10. In some embodiments, the first and second secondary soap dispensers 26 are substantially identical to each other. Although not illustrated in FIG. 1, further secondary soap dispensers may be provided within the room 10, if desired.

Figure 2:
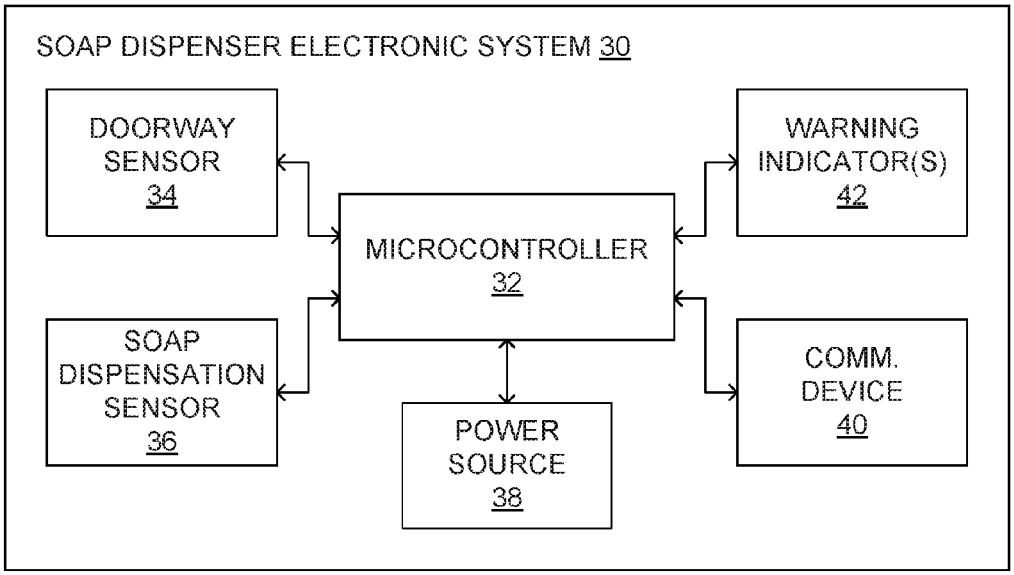
FIG. 2 is a block diagram of an embodiment of an electronic system that can be associated with one or more of the soap dispensers shown in FIG. 1.

FIG. 2 is a block diagram of an example electronic system 30 that can be associated with one or more of the soap dispensers shown in FIG. 1. In some embodiments, the electronic system 30 is an independent system that can be retrofitted to an existing soap dispenser that does not encourage hand washing. In other embodiments, the electronic system 30 can be an integral part of a soap dispenser that is integrated into the dispenser at the manufacturing stage. In either case, the electronic system 30 of FIG. 2 can comprise a microcontroller 32 that controls the overall functioning of the system. In some embodiments, the microcontroller 32 comprises an integrated circuit (IC) chip including a processor core, memory, and programmable input/output peripherals. The microcontroller 32 is coupled to each of the other components of the electronic system 30, which include a doorway sensor 34, a soap dispensation sensor 36, a power source 38, a communication device 40, and a one or more warning indicators 42, each of which is described below.

The doorway sensor 34 is configured to detect passage of an individual through a doorway or other entrance of a hospital room. In some embodiments, the doorway sensor 34 comprises a motion detector, such as a passive or active infrared (IR) sensor that is tripped when an individual passes through the doorway. Notably, in cases in which each soap dispenser comprises the same electronic system 30, the doorway sensor 34 can be disabled when the system is applied to one of the secondary soap dispensers 26.

The soap dispensation sensor 36 is a sensor that is configured to detect a soap dispensation event. For example, the dispensation sensor 36 can be the existing motion detector of the soap dispenser that detects the presence of an individual's hand below the soap dispenser, which prompts automatic, touch-free dispensation of soap. In other embodiments, the soap dispensation sensor can be a separate sensor that detects activation of a dispensing mechanism of the soap dispenser. In either case, activation of the sensor is indicative of an individual receiving soap and using it to wash his or her hands.

The power source 38 is used to supply power (voltage) to the microcontroller 32 and the other components of the electronic system 30. In some embodiments, the power source 38 comprises one or more conventional or rechargeable batteries. In other embodiments, power can be provided by an external power source, such as that supplied by the building in which the room is located.

The communication device 40 enables the various soap dispensers to communicate with each other to share information. In some embodiments, the communication devices 40 comprise wireless transceivers that implement an appropriate local area wireless protocol, such as Wi-Fi or Bluetooth. As described below, the information that is communicated between the soap dispensers can include detection of entry of an individual into the room and/or detection of dispensation of soap.

The warning indicators 42 are the components with which the hand washing compliance of an individual who has entered or exited a room can be conveyed. In some embodiments, the indicators 42 comprise one or both of one or more lights (e.g. light emitting diodes (LEDs)) that can be used to generate visual alerts and a speaker that can be used to generate audible alerts.

Figure 3:
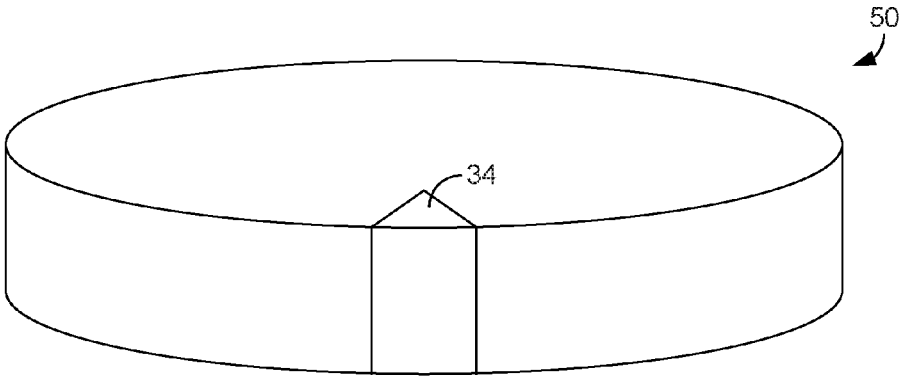
FIG. 3 is a perspective view of a first example design of a housing in which the electronic system of FIG. 2 can be packaged.
Figure 4:
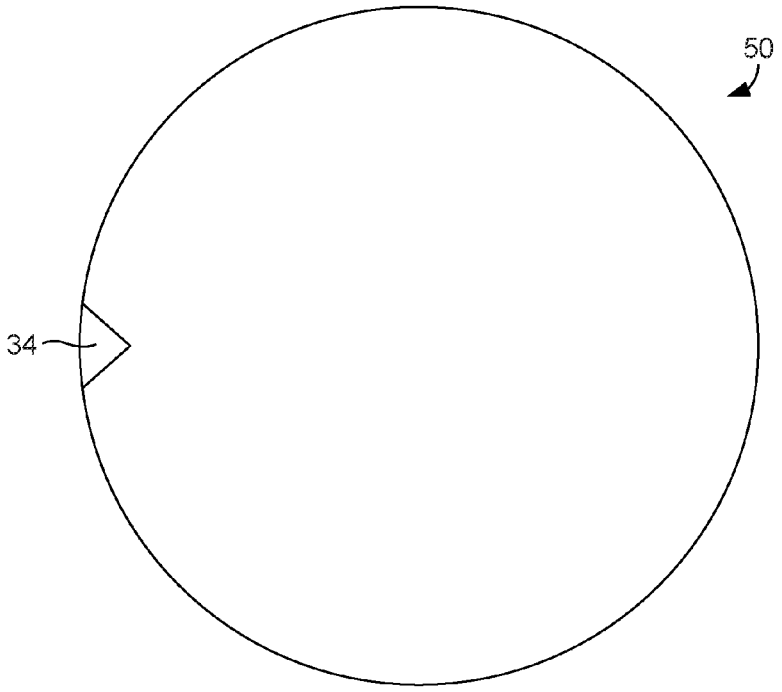
FIG. 4 is a front view of the housing of FIG. 3.

FIGS. 3 and 4 illustrate an example housing 50 in which the electronic system 30 of FIG. 2 can be packaged if not integrated into a soap dispenser. In this embodiment, the housing 50 is shaped as a short cylinder or "puck" that is approximately 10 to 20 mm tall and approximately 30 to 60 mm in diameter. As shown in the figure, the housing 50 incorporates the doorway sensor 34, which faces radially outward from the housing so as to be capable of being directed toward a room doorway.

Figure 5:
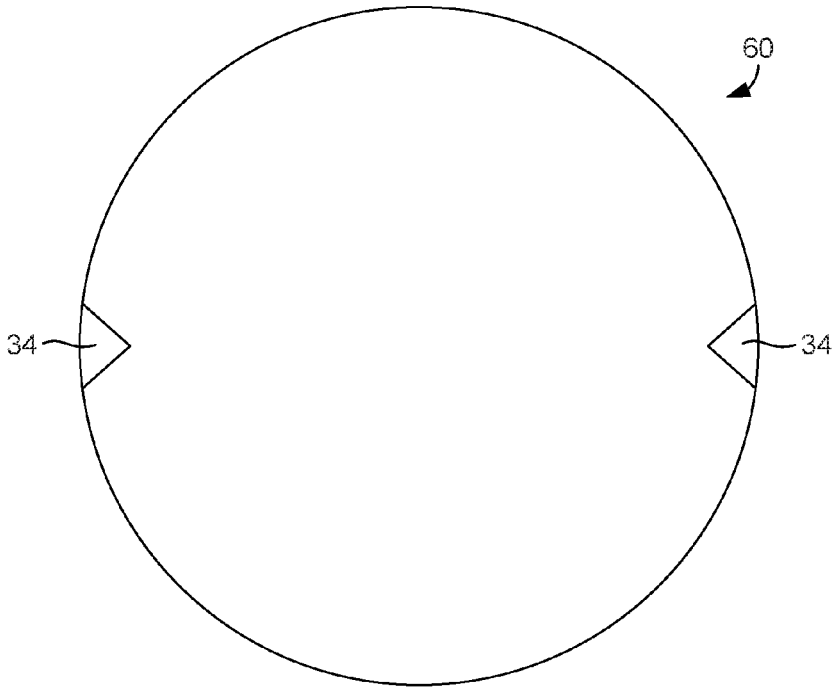
FIG. 5 is a front view of a second example design of a housing in which the electronic system of FIG. 2 can be packaged.

FIG. 5 illustrates a further example housing 60. In this example, the housing 60 includes two doorway sensors 34, which face radially outward in opposite directions from the housing. By including two doorway sensors 34, the device can be placed in the center of two adjacent rooms and provide entry detection for both room entry points.

Figure 6:
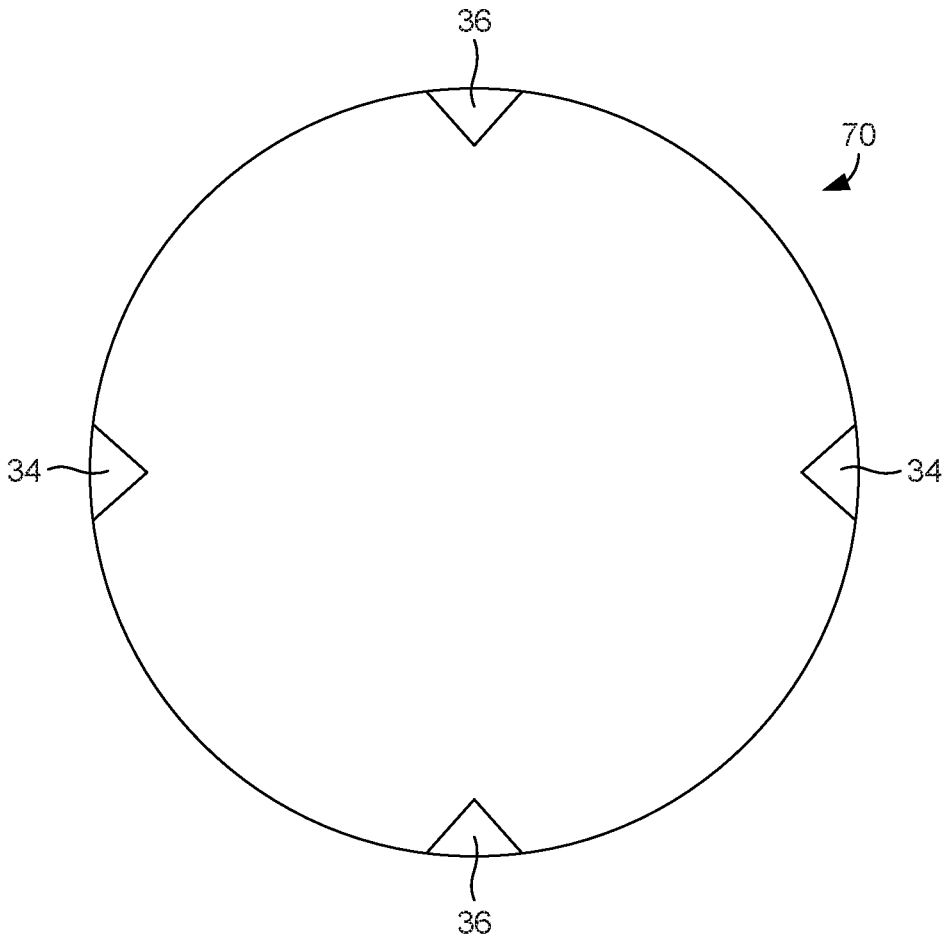
FIG. 6 is a front view of a second example design of a housing in which the electronic system of FIG. 2 can be packaged.

FIG. 6 illustrates yet another example housing 70. In this example, the housing 70 not only includes two doorway sensors 34 but also two soap dispensation sensors 36 that are adapted to detect the proximity of an individual's hands. By providing two dispensation sensors 36 at opposite sides of the housing 70, the housing 60 is adapted to be mounted to either side of a room's doorway.

Figure 7A:
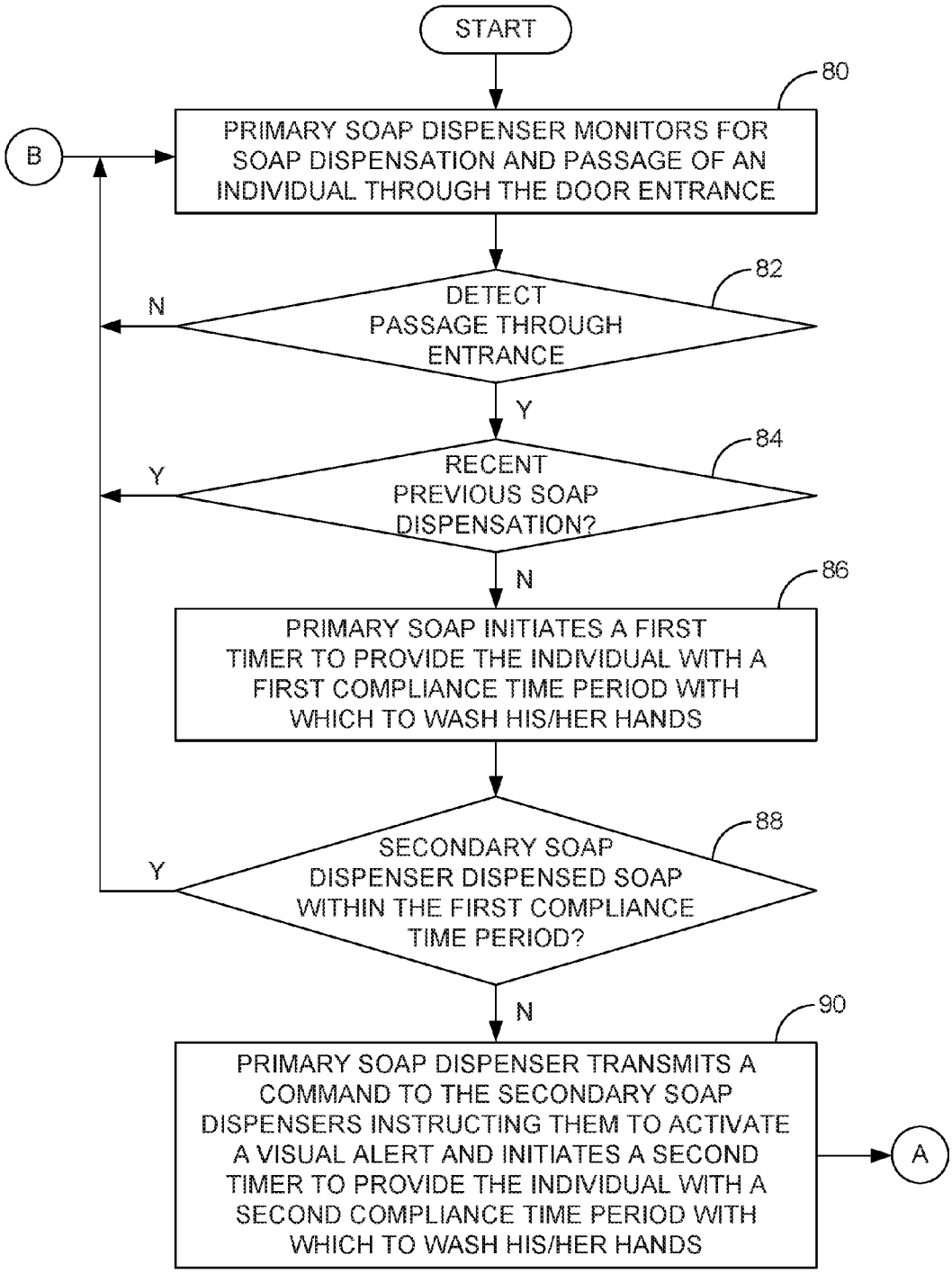
FIGS. 7A-7C comprise is a flow diagram of an example of operation of a hand washing compliance system.
Figure 7B:
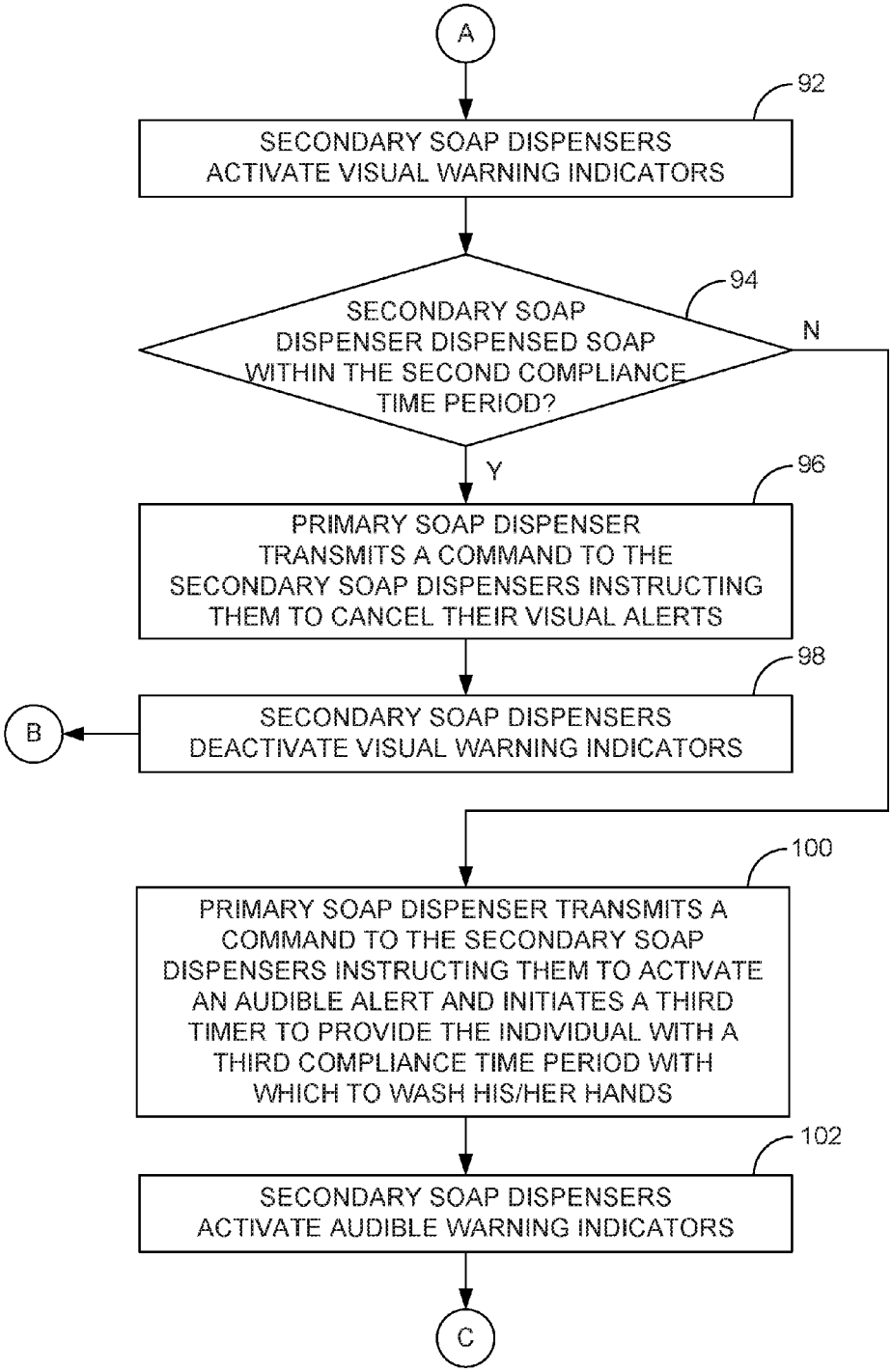

FIGS. 7A and 7B comprise a flow diagram that describes an example embodiment of a method for encouraging hand washing using a hand washing compliance system such as that described above. Although the following describes actions of the "soap dispensers," it is to be understood that at least some of the actions described in the flow diagram as being performed by the "soap dispenser" can be performed by an electronic system associated with a soap dispenser, such as that shown in FIG. 2. As noted above in relation to that figure, such an electronic system can be retrofitted to an existing soap dispenser that does not encourage hand washing. Accordingly, actions or aspects of a "soap dispenser" described in this disclosure can include actions/aspects of a soap dispenser as well as actions/aspects of an electronic system associated with a soap dispenser.

Beginning with block 80 of FIG. 7A, the primary soap dispenser continuously monitors for both soap dispensation, indicative of an individual washing his or her hands, and the passage of an individual through the room entrance, indicative of the individual entering the room. With reference to decision block 82, if the primary soap dispenser does not detect passage of an individual through the room entrance, flow returns to block 80 at which the continuous monitoring continues. If, however, passage of an individual through the room entrance is detected, flow continues to decision block 84 at which it is determined whether or not there was a recent previous soap dispensation from the primary soap dispenser, i.e., a soap dispensation immediately prior to entry. The period of time in which such dispensation is considered to be "recent" is a period of time in which an individual would likely complete washing his or her hands prior entering the room. By way of example, a recent soap dispensation can be one that occurred within the 15 to 20 seconds preceding the detected passage through the room entrance.

With further reference to decision block 84, if a recent previous soap dispensation was detected, it can be assumed that the individual who entered the room is the one who dispensed the soap and that he or she is in compliance with hospital hand washing ("wash-in") policy. In such a case, there is no need for further action and flow can return to block 80 at which the continuous monitoring continues. If, on the other hand, a recent previous soap dispensation was not detected, it can be assumed that the individual entering the room did not wash his or her hands prior to entry and is, therefore, not in compliance with hospital hand washing policy. The individual can, however, still comply with the policy by obtaining soap from one of the secondary soap dispensers within the room. Therefore, flow continues to block 86 at which the primary soap dispenser initiates a first timer to provide the individual with a first compliance time period with which to wash his or her hands in the room. By way of example, this first compliance time period can be in the range of 15 to 20 seconds.

Referring next to decision block 88, the primary soap dispenser determines whether or not a secondary soap dispenser has dispensed soap within the first compliance time period. In some embodiments, this determination is made by monitoring for signals transmitted to the primary soap dispenser from the secondary soap dispensers. When soap is dispensed from one of the secondary soap dispensers in the room, the secondary soap dispenser senses this dispensation and transmits a confirmation message to the primary soap dispenser. If such message is received within the first compliance time period, the individual who entered the room has complied with the hand washing policy. Accordingly, no further action is required and flow returns to block 80 at which the continuous monitoring continues.

If, on the other hand, none of the secondary soap dispensers detects soap dispensation within the first compliance time period, flow continues to block 90 at which the primary soap dispenser transmits a command to the secondary soap dispensers instructing them to activate a visual alert, and initiates a second timer to provide the individual with a second compliance time period with which to wash his or her hands in the room. By way of example, the second compliance time period can also be in the range of 15 to 20 seconds. In response to receiving the command from the primary soap dispenser, the secondary soap dispensers each activate a visual warning indicator, as indicated in block 92 of FIG. 7B. By way of example, the visual warning indicator can be a flashing light that reminds the individual who entered the room to wash his or her hands and notifies others in the room, such as the patient and family members, that the individual is not in compliance with the hospital's hand washing policy.

Flow next continues to decision block 94 at which the primary soap dispenser determines whether or not a secondary soap dispenser has dispensed soap within the second compliance time period. Again, this determination can be made by monitoring for signals transmitted to the primary soap dispenser from the secondary soap dispensers. If soap dispensation occurred within that time period, the individual who entered the room will have complied with the hand washing policy. In such a case, flow continues to block 96 the primary soap dispenser transmits a command to the secondary soap dispensers instructing them to cancel their visual alerts. In response to receiving this command, the secondary soap dispensers deactivate their visual warning indicators, as indicated in block 98, and flow can then again return to block 80 of FIG. 7A where continuous monitoring by the primary soap dispenser is resumed.

With reference back to decision block 94, if none of the secondary soap dispensers detects soap dispensation within the second compliance time period, flow continues to block 100 at which the primary soap dispenser transmits a command to the secondary soap dispensers instructing them to activate an audible alert, and initiates a third timer to provide the individual with a third compliance time period with which to wash his or her hands in the room. By way of example, the third compliance time period can also be in the range of 15 to 20 seconds. In response to receiving the command from the primary soap dispenser, the secondary soap dispensers each activate an audible warning indicator, as indicated in block 102.

Figure 7C:
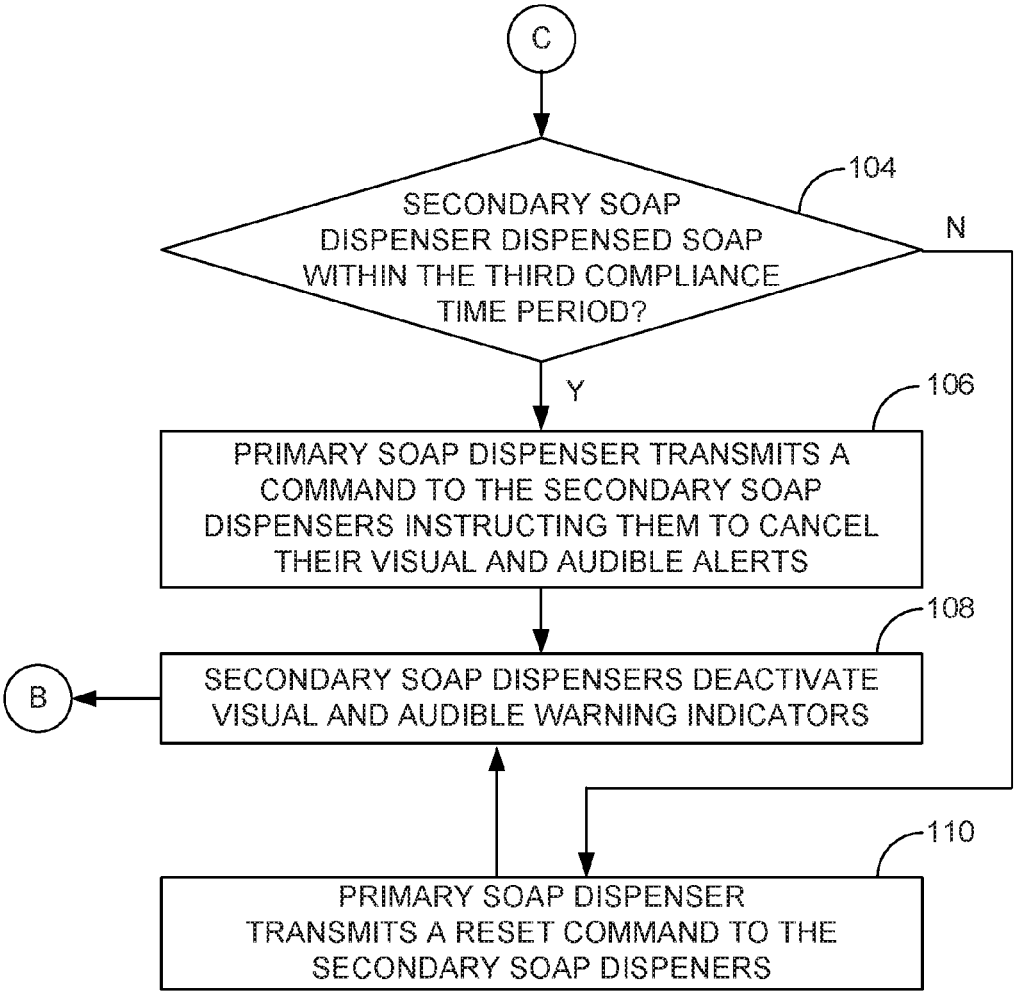

Flow next continues to decision block 104 of FIG. 7C at which the primary soap dispenser determines whether or not a secondary soap dispenser has dispensed soap within the third compliance time period. Again, this determination can be made by monitoring for signals transmitted to the primary soap dispenser from the secondary soap dispensers. If soap dispensation occurred within that time period, the individual who entered the room will have complied with the hand washing policy. Accordingly, flow continues to block 106 at which the primary soap dispenser transmits a command to the secondary soap dispensers instructing them to cancel both the visual and audible alerts. In response to receiving this command, the secondary soap dispensers deactivate their visual and audible warning indicators, as indicated in block 108, and flow can then again return to block 80 of FIG. 7A where continuous monitoring by the primary soap dispenser is resumed.

With reference back to decision block 104, if none of the secondary soap dispensers detects soap dispensation within the third predetermined time period, it is unlikely that hand washing policy compliance will be achieved. Accordingly, the system can simply be reset. In such a case, flow continues to block 110 at which the primary soap dispenser transmits a reset command to the secondary soap dispensers and, as indicated in block 108, the secondary soap dispensers deactivate their audible and visual warning indicators. Once again, flow returns to block 80 of FIG. 7A where continuous monitoring by the primary soap dispenser is resumed. Notably, resetting of the system in this manner may useful in cases in which the system mistakenly interpreted an individual leaving the room as the individual entering the room. In other embodiments, the system can be manually reset when the circumstances call for such resetting.

The above flow diagram describes just one example of operation of the hand washing compliance system. Many alternatives are possible. For instance, while the primary soap dispenser was described as controlling the secondary soap dispensers, each soap dispenser can operate independently. For instance, in some embodiments, each secondary soap dispenser can activate and deactivate its alerts on its own without waiting for a command from the primary soap dispenser.

In another alternative, the system can automatically reset in situations in which there are multiple consecutive passages through the room entrance detected. Such a circumstance may be indicative of an emergency situation in which multiple hospital staff members are rushing to the aid of a patient. In such a case, hand washing compliance may not be a top priority and a visual and/or audible alert may be a distraction.

In a further alternative, the system can be programmable so that it is deactivated for particular periods of time. For example, the system can be deactivated for night-time hours when the patient is likely sleeping.

In yet another alternative, the alerts can take other forms. For instance, an alert can comprise a recorded message that requests that the individual entering the room to wash his or her hands. As another example, an alert can comprise a playful recorded message, such as a sound clip from a movie or television show, which may come across as less officious.

To reduce the likelihood of false positive detections of room entry, one or more of the secondary soap dispensers can also comprise a motion detector that can detect the presence of the individual who has entered the room. In such a case, detected motion by the secondary soap dispenser soon after detection of an individual passing through the doorway provides a form of confirmation that the passage through the room entrance detected by the primary soap dispenser was in fact a room entry, while the absence of detected motion by the secondary soap dispenser provides an indication that the passage detected by the primary soap dispenser was actually a room exit, in which case there is no wash-in policy with which to comply.

In another embodiment, the primary soap dispenser can be configured to distinguish between room entry and room exit. By way of example, the primary soap dispenser doorway sensor can comprise two independent motion sensors that are activated by movement at different positions within the room entrance. In such a case, room entry can be distinguished from room exit by the order in which the sensors are activated. For instance, when a first sensor positioned or directed near the outside of the room entrance is tripped prior to a second sensor positioned or directed near the inside of the room entrance is tripped, it can be assumed that the individual has entered the room. If the sensors are activated in the reverse order, it can be assumed that the individual has exited the room.

While the systems disclosed above have been described as encouraging wash-in compliance, i.e., hand washing when entering a room, the system can also be configured to encourage wash-out compliance, i.e., hand washing when exiting a room. In cases in which the system encourages both forms of washing, wash-in can be encouraged with alerts issued by one or more soap dispensers within the room while wash-out can be encouraged with alerts issued by one or more soap dispensers, or other alerting devices, outside of the room.

The invention claimed is:

1. A hand washing compliance system comprising:

a primary soap dispenser adapted to be located near an entrance to a room, the primary soap dispenser comprising a motion sensor configured to detect passage of an individual through the entrance to the room, a soap dispensation sensor configured to detect dispensation of soap from the primary soap dispenser; and a wireless transceiver configured to enable direct wireless communication with other soap dispensers; and a secondary soap dispenser adapted to be located inside of the room, the secondary soap dispenser comprising a soap dispensation sensor configured to detect dispensation of soap from the secondary soap dispenser, a wireless transceiver configured to enable direct wireless communication with other soap dispensers, and a warning indicator configured to generate an alert that encourages individuals entering the room to wash their hands.

2. The system of claim 1, wherein the primary soap dispenser is configured to determine whether or not an individual who entered the room washed his or her hands immediately prior to entry.

3. The system of claim 2, wherein the primary soap dispenser determines whether or not the individual washed his or her hands immediately prior to entry by determining whether or not soap was dispensed from the primary soap dispenser within a predetermined time period prior to the primary soap dispenser detecting passage of the individual through the entrance to the room.

4. The system of claim 3, wherein the primary soap dispenser is further configured to transmit a command to the secondary soap dispenser to generate a first alert if the individual did not wash his or her hands immediately prior to entry and no communication indicative of soap dispensation is received from the secondary soap dispenser within a first compliance time period initiated after detecting passage of the individual through the room entrance.

5. The system of claim 4, wherein the secondary soap dispenser comprises a light and wherein the secondary soap dispenser is configured to activate a visual alert with the light in response to receiving the command to generate a first alert.

6. The system of claim 5, wherein the primary soap dispenser is further configured to transmit a command to the secondary soap dispenser to generate a second alert if no communication indicative of soap dispensation is received from the secondary soap dispenser within a second compliance time period initiated after transmission of the command to generate a first alert.

7. The system of claim 6, wherein the secondary soap dispenser comprises a speaker and wherein the secondary soap dispenser is configured to activate an audible alert with the speaker in response to receiving the command to generate a second alert.

8. The system of claim 1, wherein the primary soap dispenser comprises two motion sensors that enable the primary soap dispenser to distinguish between room entry and room exit.

9. The system of claim 1, wherein the system includes multiple secondary soap dispensers adapted to be located inside of the room, each secondary soap dispenser comprising a soap dispensation sensor configured to detect dispensation of soap from the secondary soap dispenser, a wireless transceiver configured to enable direct wireless communication with other soap dispensers, and a warning indicator configured to generate an alert that encourages individual entering the room to wash their hands.

* * * * *